US005357922A

United States Patent [19]

Han

[11] Patent Number: 5,357,922

[45] Date of Patent: Oct. 25, 1994

[54] UNITARY LADDER FRAME AND CYULINDER BLOCK STRUCTURE AND ENGINE BLOCK HAVING SAME

[75] Inventor: Che-Won Han, Jung, Rep. of Korea

[73] Assignee: Hyundai Motor Company, Seoul, Rep. of Korea

[21] Appl. No.: 199,884

[22] Filed: Feb. 22, 1994

[30] Foreign Application Priority Data

Sep. 14, 1993 [KR] Rep. of Korea ..... 93-18480

[51] Int. Cl.[5] ..... F02F 7/00

[52] U.S. Cl. ..... 123/195 H; 123/195 R

[58] Field of Search ..... 123/195 R, 195 H

[56] References Cited

U.S. PATENT DOCUMENTS

| | | | |
|---|---|---|---|
| 4,644,911 | 2/1987 | Hidaka et al. | 123/195 H |
| 4,669,432 | 6/1987 | Harada | 123/198 E |
| 4,878,469 | 11/1989 | Hayashi et al. | 123/195 A |
| 5,016,584 | 5/1991 | Inoue et al. | 123/195 R |

FOREIGN PATENT DOCUMENTS

| | | | |
|---|---|---|---|
| 739824 | 1/1933 | France | 123/195 R |
| 59-43486 | 12/1984 | Japan . | |
| 2150635 | 7/1985 | United Kingdom | 123/195 R |

*Primary Examiner*—Noah P. Kamen

*Attorney, Agent, or Firm*—Finnegan, Henderson, Farabow, Garrett & Dunner

[57] ABSTRACT

A cylinder block for reducing engine vibrations and noises comprises a plurality of cylinder bores, a flared skirt portion integrally molded with a lower part of the cylinder block, and a curved ladder frame portion integrally molded with a lower part of said skirt portion. The unitary molded skirt and ladder frame structure is formed in a generally gutter configuration and defines a chamber adapted to accommodate therein a bearing block mounted to a lower portion of the cylinder block. Further, the unitary molded skirt and ladder frame structure is isolated from the bearing block.

16 Claims, 5 Drawing Sheets

UNITARY LADDER FRAME AND CYULINDER BLOCK STRUCTURE AND ENGINE BLOCK HAVING SAME

FIELD OF THE INVENTION

The present invention relates to an engine block for use in a vehicle; and, more particularly, is concerned with a unitary ladder frame and cylinder block structure capable of minimizing engine vibrations and noises generated during the engine operation.

DESCRIPTION OF THE PRIOR ART

Generally, in an internal combustion engine, explosive forces are transmitted to a cylinder block and a bearing cap through a crankshaft, generating vibrations and noises. Therefore, in order to suppress the engine vibrations and noises, it is required to increase the rigidity of those vibration/noise generating parts, e.g., the cylinder block and the bearing cap, so as to enable them to withstand against various bending and torsional forces applied thereto.

A common approach for enhancing the rigidity of the engine parts is to mount a ladder frame between the cylinder block and an oil pan of the engine, which serves to suppress the vibrations at a skirt portion of the cylinder block, thereby reducing engine noises.

A typical engine block structure for enhancing the rigidity of engine parts is shown in FIG. 1. The engine block shown therein includes a cylinder block 2 having cylinder bores 4 provided therein, a flared skirt portion 6 integrally formed with the cylinder block 2, and a plurality of bearing sections 8 provided at the skirt portion 6 and arranged in a parallel relationship with each other. The respective bearing sections 8 have upper half bearing portions 10 formed at their lower central regions. In addition, a bearing cap 14 is fixed to the bearing sections 8 by means of bolts (not shown) and has lower half bearing portions 12 corresponding to the upper bearing portions 10 of the bearing sections 8. A crankshaft(not shown) is rotatably carried on the upper and lower bearing portions 10, 12 of the bearing sections 8 and the bearing cap 14.

As shown in FIG. 1, a ladder frame 16 is secured to a lower part of the skirt portion 6 by bolts 18 to increase the rigidity of the skirt portion 6. Also, an oil pan 20 is mounted to a lower part of the ladder frame 16.

As discussed above, according to the typical engine block structure, the ladder frame 16 is interposed between the skirt portion 6 of the cylinder block 2 and the oil pan 20 to enhance the rigidity of the cylinder block parts, thereby suppressing the engine vibrations.

However, although such an engine block structure may be somewhat useful for its intended purpose, it still suffers from such deficiencies that additional fastening means is needed to attach the ladder frame 16 to the cylinder block 2 and, therefore, the assembling processes of the required parts are cumbersome and highly time consuming. Particularly, extra processes such as mold preparing, drilling and thread tapping are required to manufacture the ladder frame 16, exacting a higher manufacturing cost. Furthermore, the ladder frame 16 is usually made of cast iron, which in turn increases the weight of the engine. Otherwise, the ladder frame 16 may be made of an aluminum material in order to reduce the engine weight. In case of the latter, however, the ladder frame should be manufactured in a relatively large size to properly maintain its rigidity. In addition, since the crankshaft is rotatably carried on the upper and lower bearing portions 10, 12 of the bearing sections 8 and the bearing cap 14, the crankshaft vibration generated during the operation of the engine is directly transmitted to the skirt portion 6 of the cylinder block 2 and the oil pan 20, thereby making it difficult to reduce the engine noise to a required low level.

Further, various engine block structures have been proposed to increase the rigidity of the cylinder block and the bearing cap for the purpose of suppressing the vibration and noise of the engine. For example, disclosed in U.S. Pat. No. 4,669,432 is an engine structure including an oil pan adapter for suppressing the vibrations of a cylinder block, with the adapter being mounted between the cylinder block and an oil pan.

In U.S. Pat. No. 4,878,469, there is disclosed a power plant structure for a motor vehicle which comprises a cylinder block having a skirt portion, a ladder beam mounted to the skirt portion of the cylinder block, and a transmission case fixed to the ladder beam, wherein the rigidity of the skirt portion is increased by the ladder beam to suppress the vibration of the engine.

Similarly, U.S. Pat. No. 5,016,584 describes an engine block for improving the rigidity of a cylinder block portion and a bearing portion of a crankshaft, by attaching a lower case to a lower surface of the cylinder block.

In addition, U.S. Pat. No. 4,644,911 offers an internal combustion engine in which both a portion of a cylinder block and an air intake pipe are made of a heat resistant plastic to reduce the weight of the engine and absorb the vibrations of the engine parts.

Further, in Japanese Utility Model Publication No. 84-43486, there is disclosed an engine block for damping the engine vibrations, which comprises an anti-vibration panel member bonded to a cylinder block.

Although such engine block structures as disclosed in the above prior art may be able to suppress the vibrations and noises of the engine to certain extent, they have a common deficiency in that the vibrations at the bearing portions are directly transmitted to the skirt portion of the cylinder block and the oil pan, rendering it difficult to achieve a sufficient supression of the engine vibrations and noises. Furthermore, in these engine block structures, the engine parts are individually manufactured and then assembled together, requiring rather complicated manufacturing/assembling processes thereof.

SUMMARY OF THE INVENTION

Accordingly, it is an object of the present invention to provide a unitary ladder frame and cylinder block structure which is capable of reducing engine vibrations and noises to a substantially low level.

It is another object of the present invention to provide a cylinder block which can prevent vibrations occurring at a bearing block from being transmitted to an integrally molded skirt and ladder frame structure thereof, thereby minimizing engine noises.

It is a further object of the present invention to provide an engine block which can be manufactured at a substantially low cost by virtue of simplifying the manufacturing/assembling processes of the engine parts.

The above and other objects of the present invention are accomplished by providing a cylinder block for an internal combustion engine having a plurality of cylinder bores, which comprises:

a flared skirt portion integrally molded with a lower part of said cylinder block; and a curved ladder frame portion integrally molded with a lower part of said skirt portion, said unitary skirt and ladder frame structure defining a chamber suitable for accommodating therein a bearing block mounted to a lower portion of said cylinder block.

In accordance with another aspect of the present invention, there is provided an engine block for use in a vehicle, which comprises:

a cylinder head;

a cylinder block mounted to a lower portion of said cylinder head, said cylinder block including a flared skirt portion integrally molded with a lower part thereof, and a curved ladder frame portion integrally molded with a lower part of said skirt portion;

a bearing block secured to a lower portion of said cylinder block for rotatably supporting a crankshaft; and means for clamping said cylinder head, said cylinder block and said bearing block together.

The unitary molded skirt and ladder frame structure of the cylinder block is isolated from the bearing block, thereby preventing the vibrations of the bearing block from being transmitted thereto. This results in a substantial reduction of the engine noises. The bearing block consists of an upper bearing cap secured to the lower portion of the cylinder block and a lower bearing cap clamped to the upper bearing cap.

BRIEF DESCRIPTION OF THE DRAWINGS

The above and other objects, and features of the present invention will become apparent from the following descriptions, given in conjunction with the accompanying drawings, wherein.

DETAILED DESCRIPTION OF THE PREFERRED EMBODIMENTS

Figure 2:
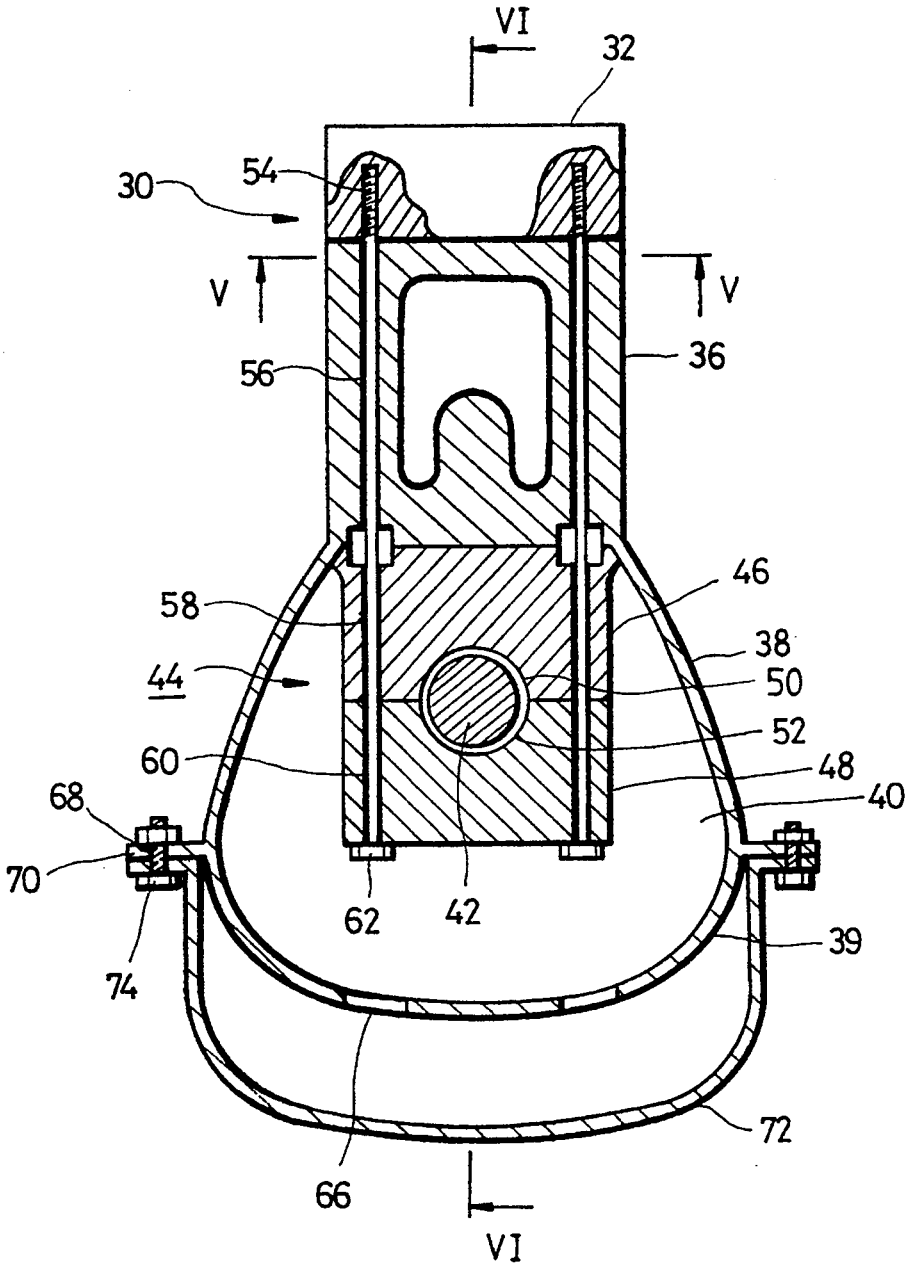
FIG. 2 is a vertical sectional view of an engine block structure taken along line II—II illustrated in FIG. 5 in accordance with a preferred embodiment of the present invention.

Referring now to FIG. 2, there is shown an engine block structure generally designated with reference numeral 30, in accordance with a preferred embodiment of the present invention. The engine block 30 comprises a cylinder head 32, and a cylinder block 36 mounted to a lower portion of the cylinder head 32 and having a plurality of cylinder bores 34 formed therein (see FIG. 4). The cylinder block 36 includes a flared skirt portion 38 integrally molded with a lower part thereof, and a curved ladder frame portion 39 integrally molded with a lower part of the skirt portion 38. The skirt portion 38 and the ladder frame portion 39 together are molded with the cylinder block 36 in an appropriate manner.

Figure 1:
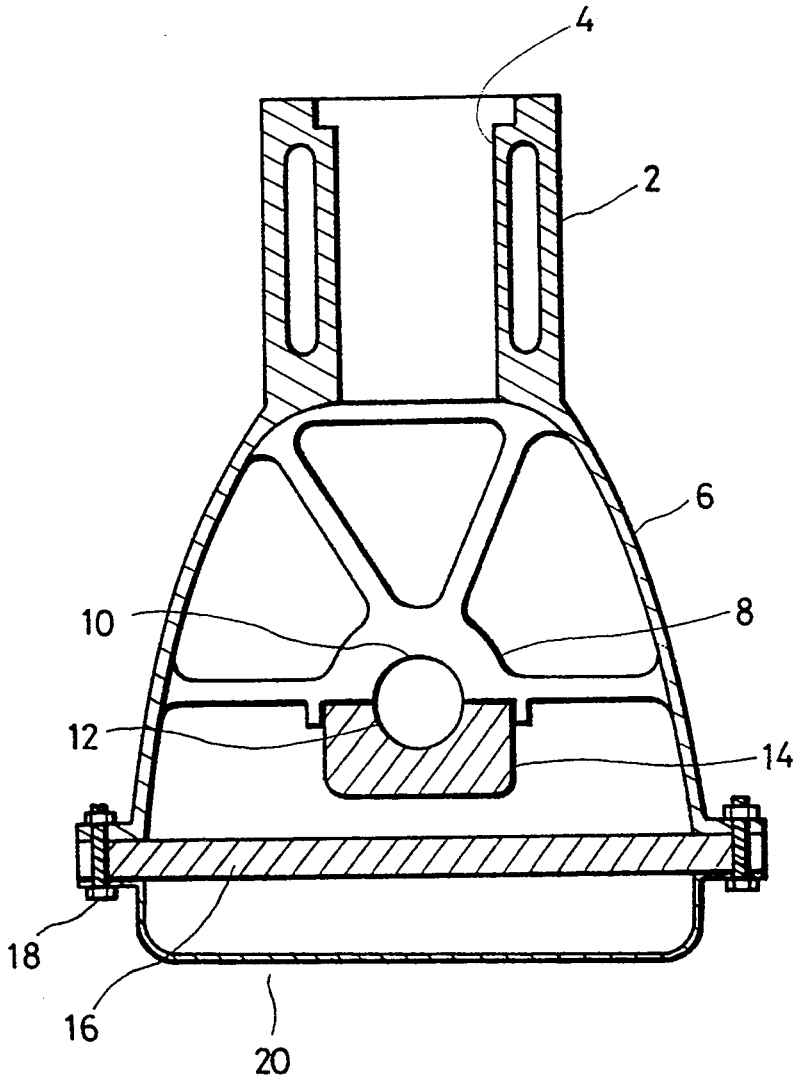
FIG.1 (PRIOR ART)
FIG. 1 is a partial vertical sectional view of an engine block structure according to the prior art.

In accordance with a preferred embodiment of the present invention, the ladder frame portion 39 is integrally molded with the skirt portion 38 to constitute a unitary structure, removing a coupling process of a ladder frame to a skirt portion of a cylinder black as employed in the above-mentioned conventional engine blocks. Therefore, the assembling processes of the engine parts are substantially simplified. In addition, no extra equipment or efforts are required to manufacture the ladder frame, thereby reducing the manufacturing cost of the engine. Furthermore, with the unitary molding of the skirt and ladder frame structure, the weight of the ladder frame 39 can be effectively reduced to render the overall weight of the engine to be substantially lesser than the typical engine shown in FIG. 1, while the rigidity of the skirt portion 38 is increased with the provision of the ladder frame portion 39 integrally molded therewith to thereby effectively suppress the vibrations of the skirt portion 38. Consequently, the engine noises are effectively reduced to a desired low level. In particular, the unitary molded skirt and ladder frame structure is formed in, e.g., a generally gutter configuration. It is preferable that the unitary skirt and ladder frame structure define a chamber 40 which is configured to accommodate therein a bearing block 44 mounted to a lower portion of the cylinder block 36.

Figure 3:
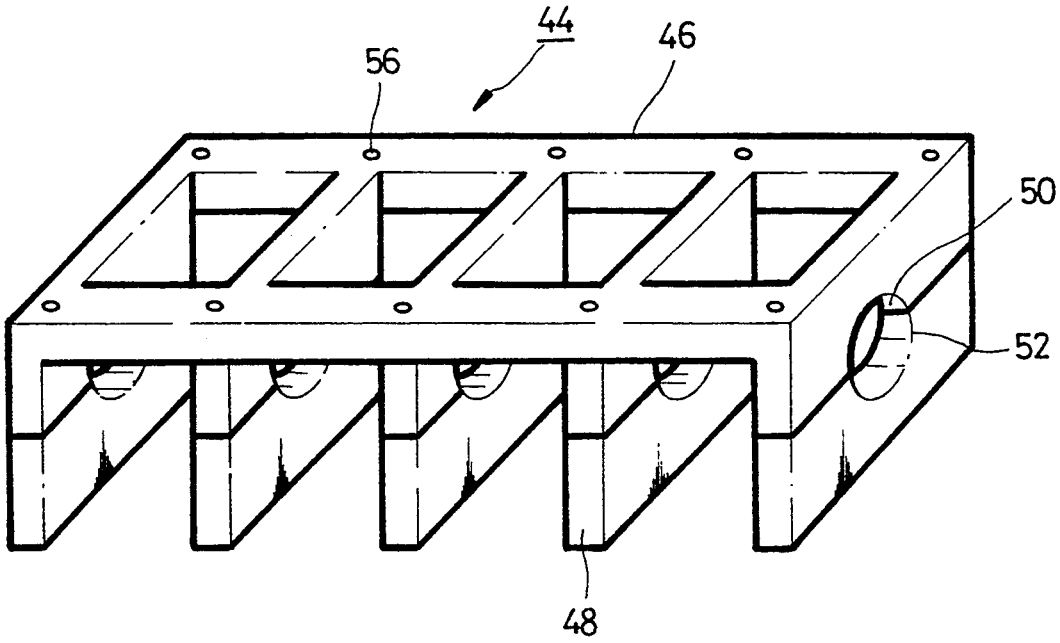
FIG. 3 is a perspective view of a bearing block shown in FIG. 2.

As best shown in FIG. 3, the bearing block 44 includes an upper bearing cap 46 secured to the lower portion of the cylinder block 36, and a lower bearing cap 48 clamped to the upper bearing cap 46. Further, the respective bearing caps 46, 48 have upper and lower half bearing portions 50, 52 formed thereat in an opposite relationship with each other, on which a crankshaft 42 is rotatably carried (see FIG. 2).

Referring back to FIG. 2, the cylinder head 32 has a plurality of threaded holes 54 formed therein. In addition, provided in the cylinder block 36 and the bearing caps 46, 48 are through-holes 56, 58, 60 which are disposed to register with the respective threaded holes 54 of the cylinder head 32. Further, formed at the ladder frame portion 39 of the cylinder block 36 are apertures 66 which are arranged to oppose the through-holes 60 of the lower bearing cap 48 (see FIG. 2). The apertures 66 of the ladder frame portion 39 are designed to easily pass elongated clamping bolts 62 therethrough in assembling the engine parts. Therefore, the elongated bolts 62 are inserted into the through-holes 60, 58 of the bearing block 44 and the through-holes 56 of the cylinder block 36 via the apertures 66 of the ladder frame portion 39 and then coupled to the threaded holes 54 of the cylinder head 32. As a result, the cylinder head 32, the cylinder block 36 and the bearing block 44 together are firmly clamped with each other by way of the elongated bolts 62, further simplifying the assembling processes of the engine parts.

As illustrated in FIG. 2, in accordance with a preferred embodiment of the present invention, the unitary molded skirt and ladder frame structure is isolated from the bearing block 44. Therefore, the vibrations of the bearing block 44 are not transmitted to the skirt portion 38 and the ladder frame portion 39, effectively reducing the engine noises to a sufficiently low level.

Figure 4:
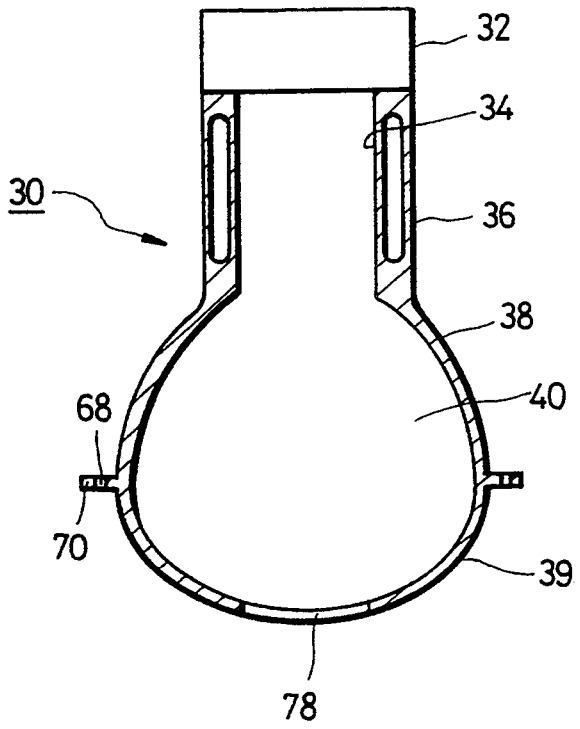
FIG. 4 is a partial vertical sectional view taken along line IV—IV indicated in FIG. 5, with a bearing block and an oil pan removed for clarity.

As shown in FIGS. 2 and 4, the skirt portion 38 of the cylinder block 36 includes flanges 70 formed at its lower outside regions, which have a plurality of bolt holes 68, respectively. Further, coupled to the flanges 70 of the skirt portion 38 by bolts 74 is an oil pan 72 which is adapted to store engine oil therein. As discussed above, with the separation of the unitary skirt and ladder frame structure from the bearing block 44, the oil pan 72 is not subjected to the vibrations of the bearing block 44.

Figure 6:
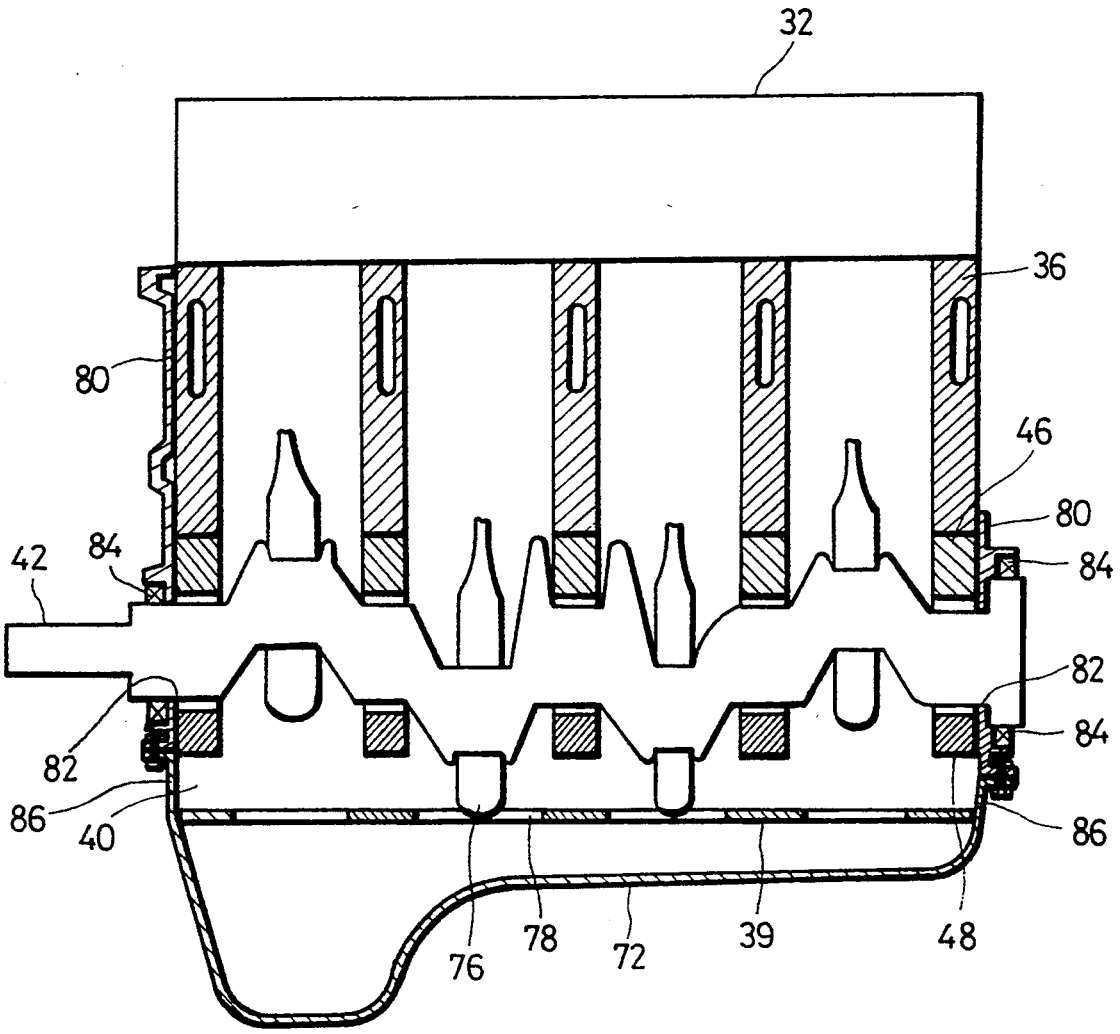
FIG. 6 is a partial vertical sectional view taken along line VI—VI marked in FIG. 2.

As best shown in FIGS. 4 and 6, the ladder frame portion 39 of the cylinder block 36 is provided with a plurality of relatively large openings 78 which are arranged in an opposite relationship with connecting rods 76 coupled to the crankshaft 42, respectively, thereby enabling them not to interfere with reciprocating motions of the connecting rods 76 during the engine operation. Further, these openings 78 serve as passage ways which circulate engine oil stored in the oil pan 72 therethrough to lubricate the engine parts.

Figure 5:
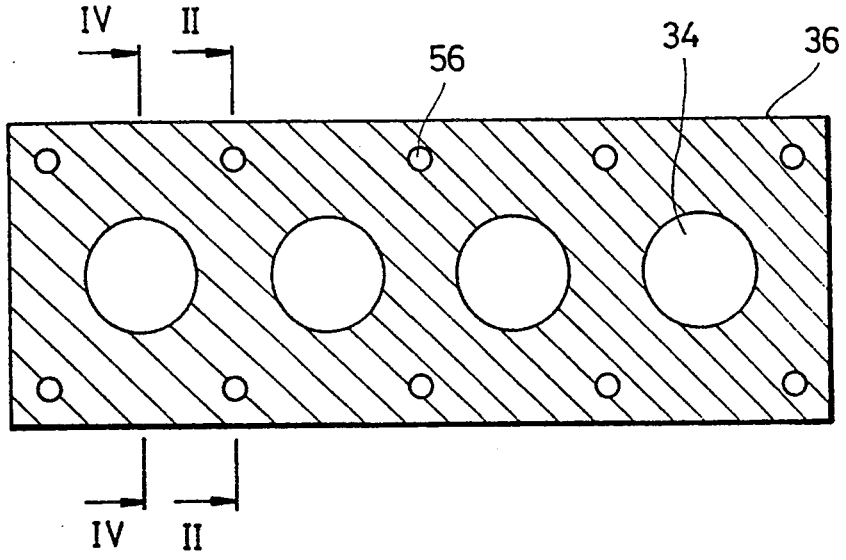
FIG. 5 is a cross sectional view taken along line V—V denoted in FIG. 2.

FIG. 5 shows an in-line type of a cylinder block having four cylinder bores 34 in accordance with a preferred embodiment of the present invention. The invention is not, however, limited to this type of the cylinder block structure shown in FIG. 5; and may be designed to have an appropriate number of cylinder bores 34, depending on its use.

Referring now to FIG. 6, as described above, the crankshaft 42 is rotatably supported at the upper and the lower bearing caps 46, 48. In addition, attached to side walls (not shown ) of the unitary molded skirt and ladder frame structure are seal plates 80 which are adapted to shield the chamber 40 from external environment. Also, lower parts of the seal plates 80 are assembled with side portions 86 of the oil pan 72. The respective seal plates 80 have holes 82 formed therein, which are designed to pass the crankshaft 42 therethrough. Further, provided at the seal plates 80 are oil sealants 84 which can seal airtightly the crankshaft 42.

Although the invention has been shown and described with respect to the preferred embodiments, it will be understood by those skilled in the art that certain changes and modifications may be made without departing from the spirit and scope of the invention as defined in the following claims.

What is claimed is:

1. A cylinder block for an internal combustion engine having a plurality of cylinder bores, which comprises:

a flared skirt portion integrally molded with a lower part of said cylinder block; and a curved ladder frame portion integrally molded with a lower part of said skirt portion, said integrally molded skirt and ladder frame structure defining a chamber suitable for accommodating therein a bearing block mounted to a lower portion of said cylinder block.

2. The cylinder block of claim 1, wherein said integrally molded skirt and ladder frame structure is formed in a generally gutter configuration.

3. The cylinder block of claim 2, wherein said integrally molded skirt and ladder frame structure is isolated from said bearing block.

4. The cylinder block of claim 3, wherein said ladder frame portion includes a plurality of apertures for passing elongated clamping bolts therethrough.

5. The cylinder block of claim 4, wherein said ladder frame portion further includes a plurality of relatively large openings which are adapted not to interfere with reciprocating motions of connecting rods.

6. The cylinder block of claim 5, wherein said skirt portion includes flanges formed at its lower outside regions, to which an oil pan is coupled.

7. An engine block for use in a vehicle, which comprises:

a cylinder head;

a cylinder block mounted to a lower portion of said cylinder head, said cylinder block including a flared skirt portion integrally molded with a lower part thereof, and a curved ladder frame portion integrally molded with a lower part of said skirt portion;

a bearing block secured to a lower portion of said cylinder block for rotatably supporting a crankshaft; and means for securing said cylinder head, said cylinder block and said bearing block together.

8. The engine block of claim 7, wherein said integrally molded skirt and ladder frame structure defines a chamber suitable for accommodating therein said cylinder block.

9. The engine block of claim 8, wherein said integrally molded skirt and ladder frame structure is formed in a generally gutter configuration.

10. The engine block of claim 9, wherein said integrally molded skirt and ladder frame structure is isolated from said bearing block.

11. The engine block of claim 10, wherein said bearing block includes an upper bearing cap secured to the lower portion of said cylinder block and a lower bearing cap clamped to said upper bearing cap.

12. The engine block of claim 11, wherein said upper and lower bearing caps have upper and lower half bearing portions arranged in an opposite relationship with each other, respectively, on which the crankshaft is rotatably carried.

13. The engine block of claim 10, wherein said securing means includes threaded holes provided in said cylinder head, through-holes provided in said cylinder block and said bearing block and disposed to register with said respective threaded holes of said cylinder head, and elongated clamping bolts inserted into said respective through-holes of said cylinder and bearing blocks and coupled to said respective threaded holes.

14. The engine block of claim 13, wherein said ladder frame portion includes a plurality of apertures for passing the elongated clamping bolts therethrough.

15. The engine block of claim 13, wherein said ladder frame portion further includes a plurality of relatively large openings which are adapted not to interfere with reciprocating motions of connecting rods.

16. The engine block of claim 7, further comprising an oil pan coupled to flanges of said skirt portion and disposed below said ladder frame portion.

* * * * *

UNITED STATES PATENT AND TRADEMARK OFFICE

CERTIFICATE OF CORRECTION

PATENT NO. : 5,357,922
DATED : October 25, 1994
INVENTOR(S) : Che-Won Han

It is certified that error appears in the above-indentified patent and that said Letters Patent is hereby corrected as shown below:

Title page, item [54] and col. 1, line 1, in the Title , change "CYULINDER" to --CYLINDER--.

Signed and Sealed this
Seventh Day of March, 1995

*Attest:*

*Attesting Officer*

Bruce Lehman

BRUCE LEHMAN

*Commissioner of Patents and Trademarks*